United States Patent [19]

Machen et al.

[11] Patent Number: 4,967,569

[45] Date of Patent: Nov. 6, 1990

[54] PORTABLE AIR-CONDITIONING UNIT FOR THROUGH-HATCH MARINE USE

[75] Inventors: Edmund H. Machen, Charlotte, N.C.; Douglas E. Winters, Richmond, Va.

[73] Assignee: Marine Products, Inc., Richmond, Va.

[21] Appl. No.: 414,954

[22] Filed: Sep. 29, 1989

[51] Int. Cl.[5] ..... B63J 2/04

[52] U.S. Cl. ..... 62/240; 62/429

[58] Field of Search ..... 62/240, DIG. 16, 429; 33/333, 354

[56] References Cited

U.S. PATENT DOCUMENTS

| | | | |
|---|---|---|---|
| 2,737,788 | 3/1956 | Buttner | 62/429 X |
| 3,116,563 | 1/1964 | Gelbman | 33/354 |
| 3,416,329 | 12/1968 | Thomas | 62/429 X |
| 3,918,271 | 11/1975 | Whisler | 62/289 X |
| 4,608,834 | 9/1986 | Rummel | 62/DIG. 16 |
| 4,641,502 | 2/1987 | Aldrich et al. | 62/DIG. 16 |
| 4,745,769 | 5/1988 | Wooden, Jr. | 62/DIG. 16 |

*Primary Examiner*—William E. Tapolcai

*Attorney, Agent, or Firm*—W. Brown Morton, Jr.

[57] ABSTRACT

This invention relates to portable air-conditioning units for through-hatch marine use which have their conventional air-conditioning mechanisms carried on a base member above the hatch opening and which employs a cover shell enclosing said mechanisms divided into two compartments internally, one compartment not communicating with the outside air which contains a cooling coil and a fan for moving air from a duct which has an opening below the hatch through the coil and back through another duct which also has an opening below the hatch and the other compartment not communicating below the hatch which contains the compressor, a heat exchanger, and another fan for moving outside air through the exchanger. Various shrouds, adjustable supports, and level indicators may be included in the units.

4 Claims, 4 Drawing Sheets

PORTABLE AIR-CONDITIONING UNIT FOR THROUGH-HATCH MARINE USE

BACKGROUND OF THE INVENTION

Boats, power and sail, with cruising accommodations especially in the 20 to 40 foot range, are not often equipped with built-in air conditioning systems to make cabins comfortable places to eat and sleep dockside in hot, humid summer weather. This invention is directed to providing a unit which solves this problem by (1) through-hatch mounting, so that the unit occupies the minimum of the limited below-deck space, but provides convenient below-deck access to its controls; (2) ready adaptability to the usual range of hatch parameters; (3) easy and tool-free installation and removal, without disconnecting the hatch cover, if hinged; and (4) above-deck location of the mechanisms, in an easily-portable, self-contained, weather-proof assembly.

FIELD OF THE INVENTION

This invention relates to an air-conditioning unit especially suitable for through-hatch dockside use in boats having a below-deck accommodations and provides ready portability, easy tool-free installation, top-side mechanisms, and convenient inside controls.

DESCRIPTION OF THE PRIOR ART

Roof-mounted air conditioning units are common in the prior art, especially for use on vans, mobile homes, and various vehicles such as RVs, trucks, rail cars, and boats. One such is shown in U.S. Pat. No. 4,608,834, granted Sep. 2, 1986, to Rummel in which the unit is designed especially for use in truck cab roof openings to have a specially low height and to replace the hinged ventilating door usually covering such openings. Other pertinent patents are U.S. Pat. Nos. 4,641,502, granted Feb. 10, 1987 to Aldrich et al. and 4,672,818, granted Jun. 16, 1987 to Roth. None of these prior art devices is intended to be readily portable or quickly mountable and demountable.

SUMMARY

This invention is basically a novel and superior assembly of conventional room air-conditioner elements—compressor, heat exchanger, cooling coil, fan and motor, wiring, controls, and ducting—into a portable, through-hatch unit having a well-located center of mass, convenient handles for handles, leveling means, efficientd air flow channelling, accessible controls, and a functional outer shell. U.S. Des. patent application Ser. No. 07/246,654 is directed to one appearance which this assembly invention facilitates. Mounting is readily adjusted to varying deck slopes to keep its mechanisms level while one end rests on the hatch combing and the other end is supported on the deck or cabin roof surface surrounding the hatch opening. Heat exchanger air circulation is wholly topside; hot interior air is drawn into the unit, conditioned and returned, cooled and dehumidified, via through-hatch ducts. In what follows it will be assumed is the unit is to be installed in a hatch through a foredeck area sloping down toward the bow. A "bag" is secured to the after end of the installed unit and to the hatch opening covering them and keeping weather out without hindering the draining of condensate from the cooling coil on to the deck.

DETAILED DESCRIPTION

The portable air-conditioning unit for through-hatch marine use hereinafter described by reference to the accompanying drawings is a preferred embodiment of our invention and, in the example selected for illustration, is about 14 inches high from the deck, 16 inches wide, and 312 inches long. It weighs about 59 pounds and, when used with 115 volt AC, it draws about 6 amps running, producing a cooling effect of about 4200 BTU/HR. These specifications are given by way of example merely and are not to be taken as limiting our invention which is particularly pointed out in the appended claims.

Figure 1:
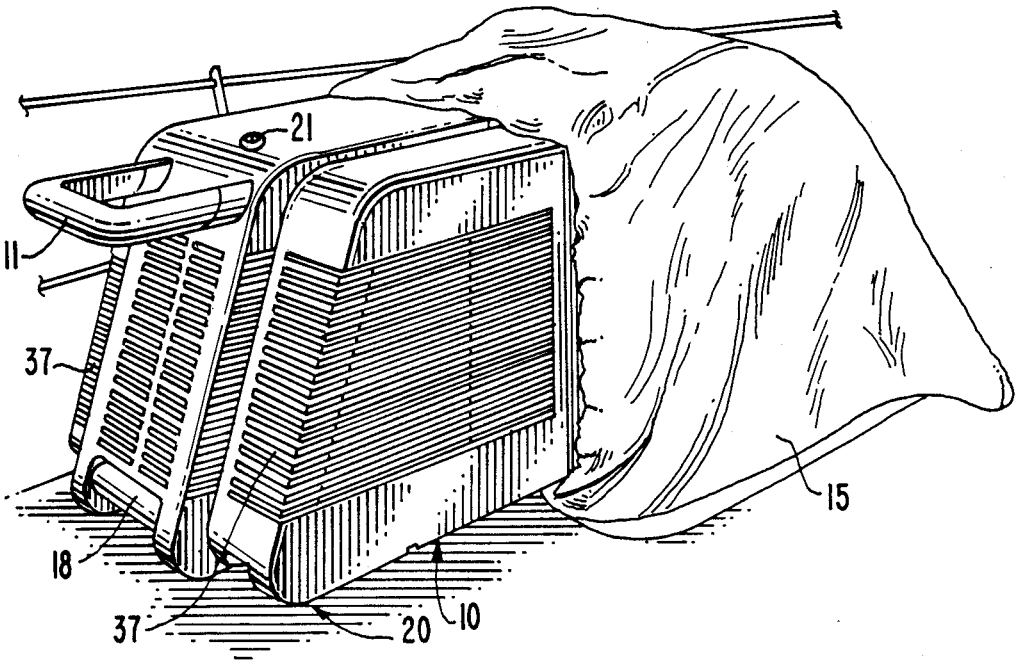
FIG. 1 is a perspective view from the bow of the port side of a unit according to the invention installed on a boat's hatch with its weather bag in place.
Figure 2:
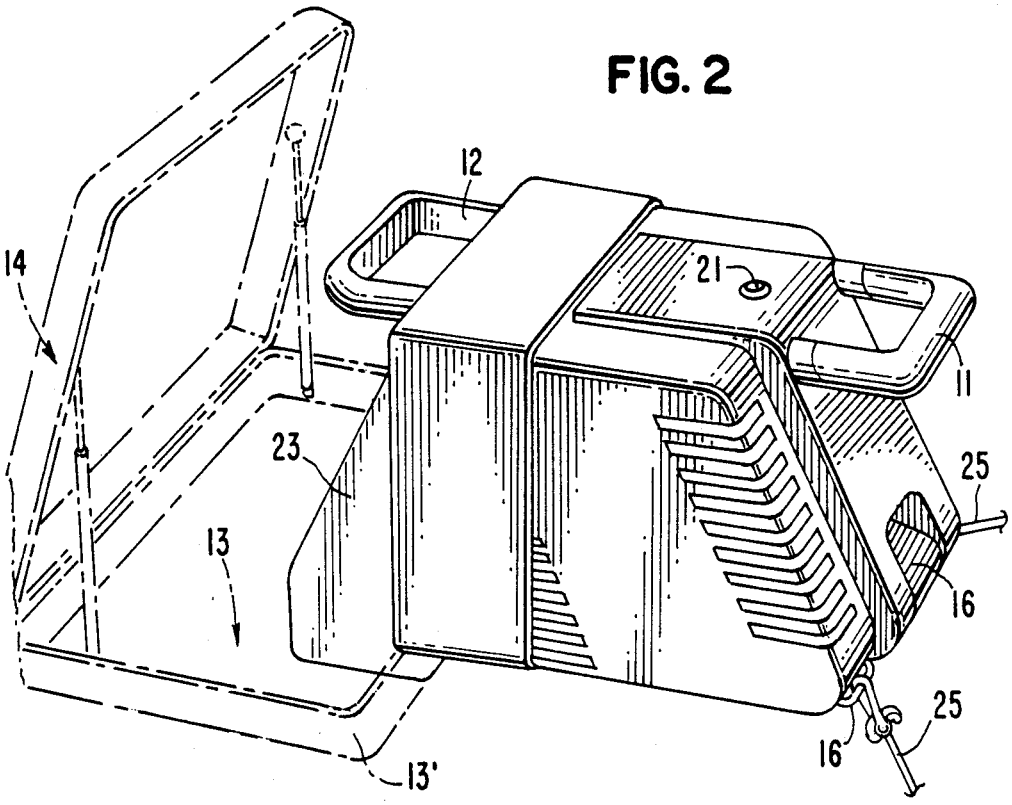
FIG. 2 is a perspective view from the bow of the starboard side of the unit shown in FIG. 1 without its weather bag and with the hatch cover and combing indicated in phantom.
Figure 3:
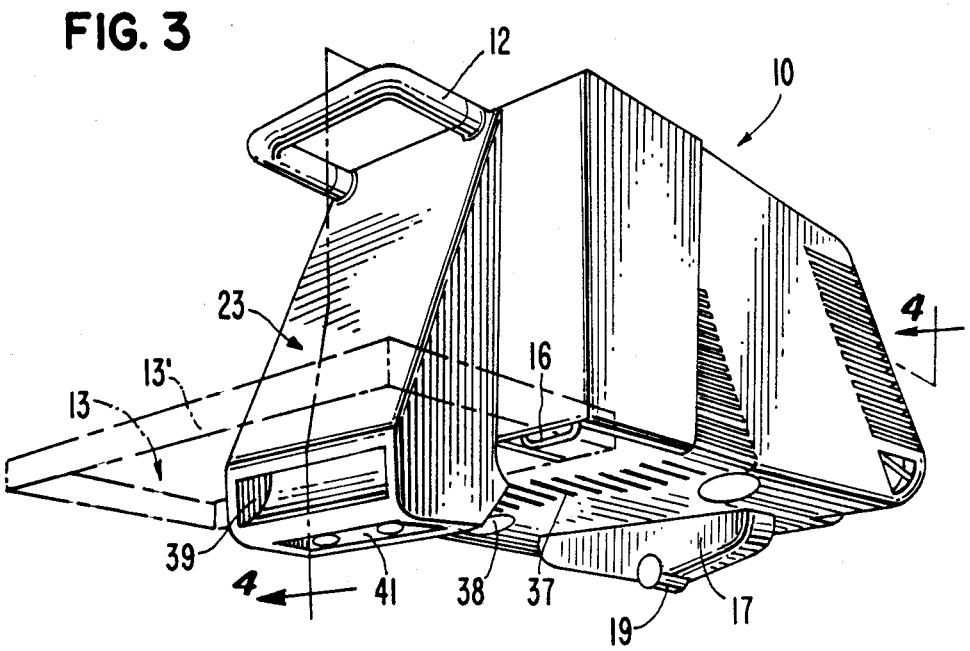
FIG. 3 is a perspective view from below looking forward of the unit shown in FIG. 2 with the hatch combing indicated in phantom.
Figure 4:
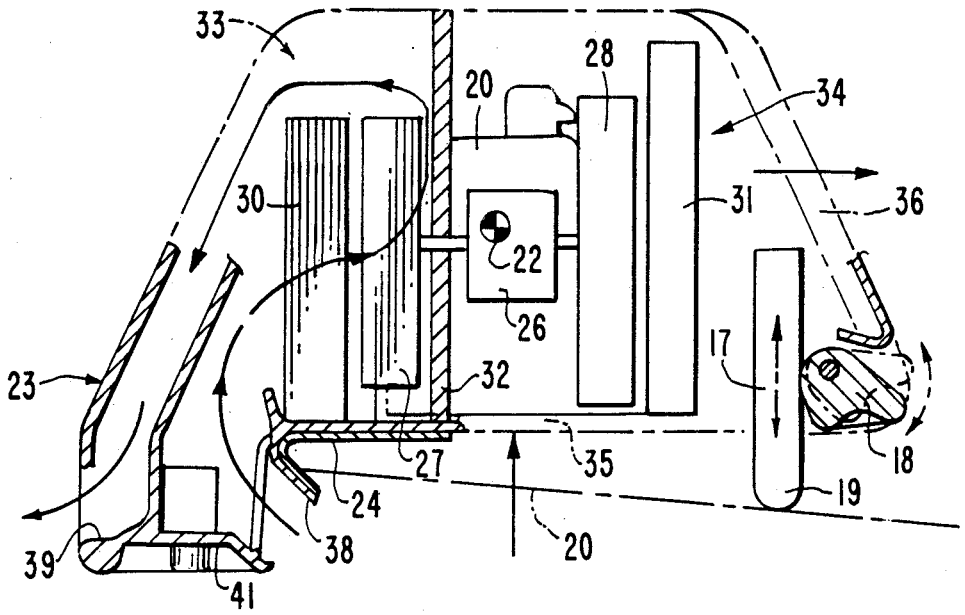
FIG. 4 is a diagrammed center-line, fore and aft cross-section, partially in phantom, on the line 4—4 of FIG. 3.
Figure 5:
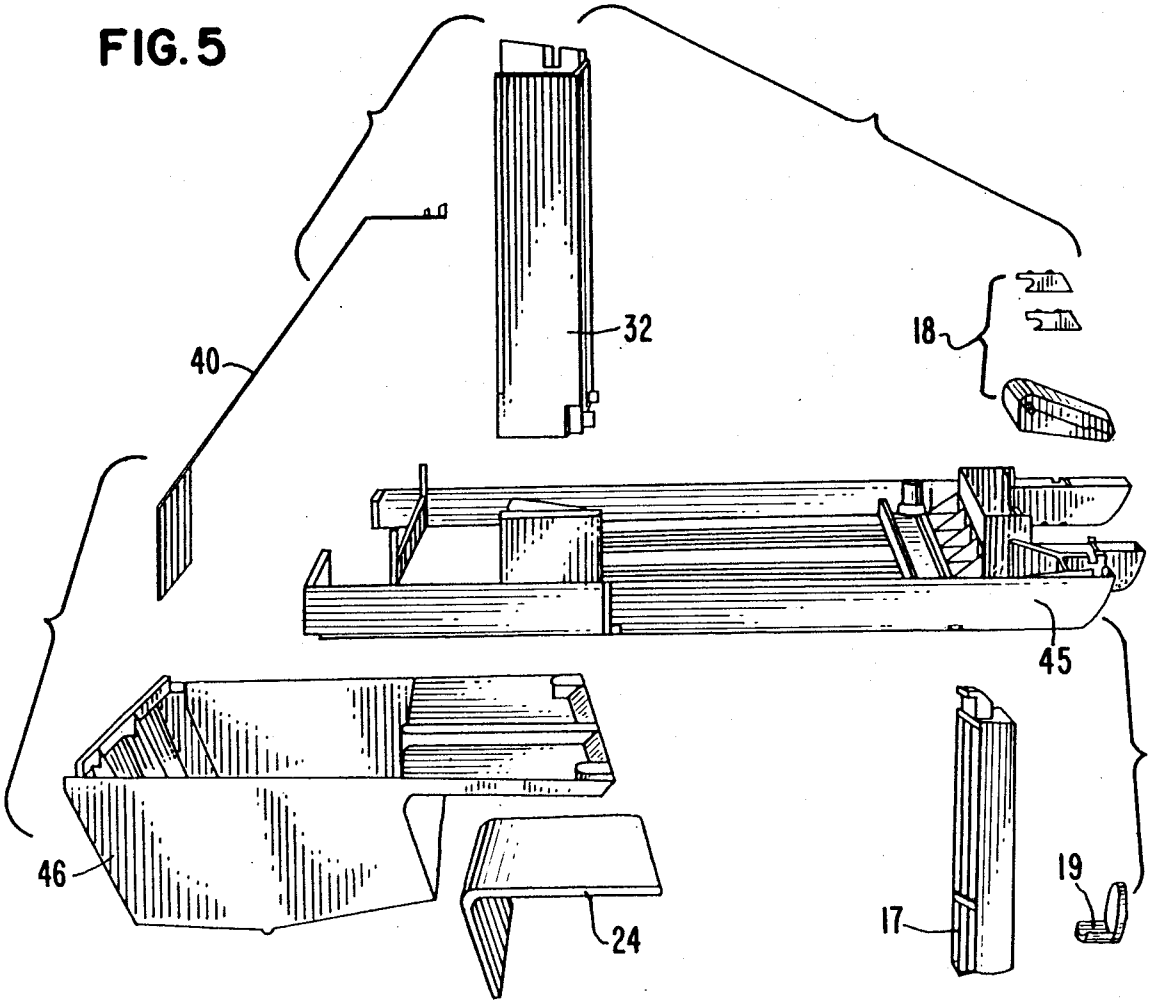
FIG. 5 is an exploded view showing in perspective key parts of the unit shown in FIGS. 1–4.

Turning now to the drawings, the unit of our invention is generally designated 10. As shown in FIGS. 3, 4, & 5, it is positioned in use with its after end over an open hatch 13 and its forward end supported by the padded foot 19 of leg 17 resting on deck (or cabin roof) 20. Leg 17 is carried by the unit slidably and is free to move vertically unless locked in place by the camming action of rotatable locking handle 18 as best shown in FIG. 4. Unit 10 is carried to and positioned on and in hatch 13 by the forward handle 11 and the after handle 12, by one or two people, who lower its after end's rearwardly extending duct housing 23 down through hatch 13 with a hooking action which places hatch pad 24 on the combing 13' and extending into the opening of hatch 13. Leg 17 is then permitted to slide to the extended position appropriate to hold the unit 10 level as required by the slope of the particular deck 20 involved. A level bubble 21 on the top surface of unit 10 facilitates its accurate positioning. It is necessary that the unit not be operated unless it is positioned within 10 degrees of level. The hatch pad 24 insulates and protects both the unit and the combing. Its downwardly extending portion exerts a wedging action that helps to hold the unit in place and this may be supplemented by lashings 25 tied to the unit 10 by D-ring tie-downs 16 if disturbance by, for example, the wakes of passing vessels is anticipated. After unit 10 is positioned as described, weather bag 15 is secured in place by shock cord girding the after end of the unit and a frame of battens surrounding the combing 13'. Bag 15 thus covers the after carrying handle 12 and the hatch cover 14 and keeps outside wind and weather out of the conditioned space of the cabin.

The mechanisms by which unit 10 accomplishes its air conditioning functioning per se are conventional and are shown diagrammatically in FIG. 4, which also shows the air circulation channels of the unit. A motor 26 drives two shrouded fans, the cooling coil fan 27 and the heat exchanger fan 28. A compressor 29 circulates refrigerant in the usual way through the cooling coil 30 and the heat exchanger 31. A bulkhead 32 inside the unit's outer shell separates the space therein into an after compartment 33 containing the cooling coil 30 and its fan 27 and a foward compartment containing the compressor 29, the fan motor 26, the heat exchanger 31 and its fan 28, the forward support leg 17 and its locking mechanism 18. The center of mass 22 of the unit is located in the horizontal plane of the quartered circular indicator in FIG. 4 approximately at the intersection of the fore-and-aft and thwartship center lines it that plane but displaced a bit aft and to port thereof by the weight of the compressor. Such central location of the center of mass contributes greatly to the portability of the unit and the ease with which it can be manipulated during installation. The outside air forced by fan 28 through heat exchanger 31 is drawn into the shell forward of the bulkhead 33 through bottom grills 36 and vented through forward grills 37. The cabin air being conditioned is drawn into the shell by fan 27 through filter 38 at the entrance to duct 39, forced through the cooling coil 27, and discharged via duct 40. Ducts 39 and 40 are formed in housing 23 by separator 42.

Controls for the unit 10 are positioned inside the cabin at the lower end of duct housing 23 in panel 41. They comprise knob 42 for setting a thermostat responsive to cabin temperature to control compressor 29 and knob 43 for controlling the speed of fan motor 26. Panel 41 also carries recessed three-wire male plug 44 by which a drop cord can make a properly grounded connection to dockside power.

Figure 6:
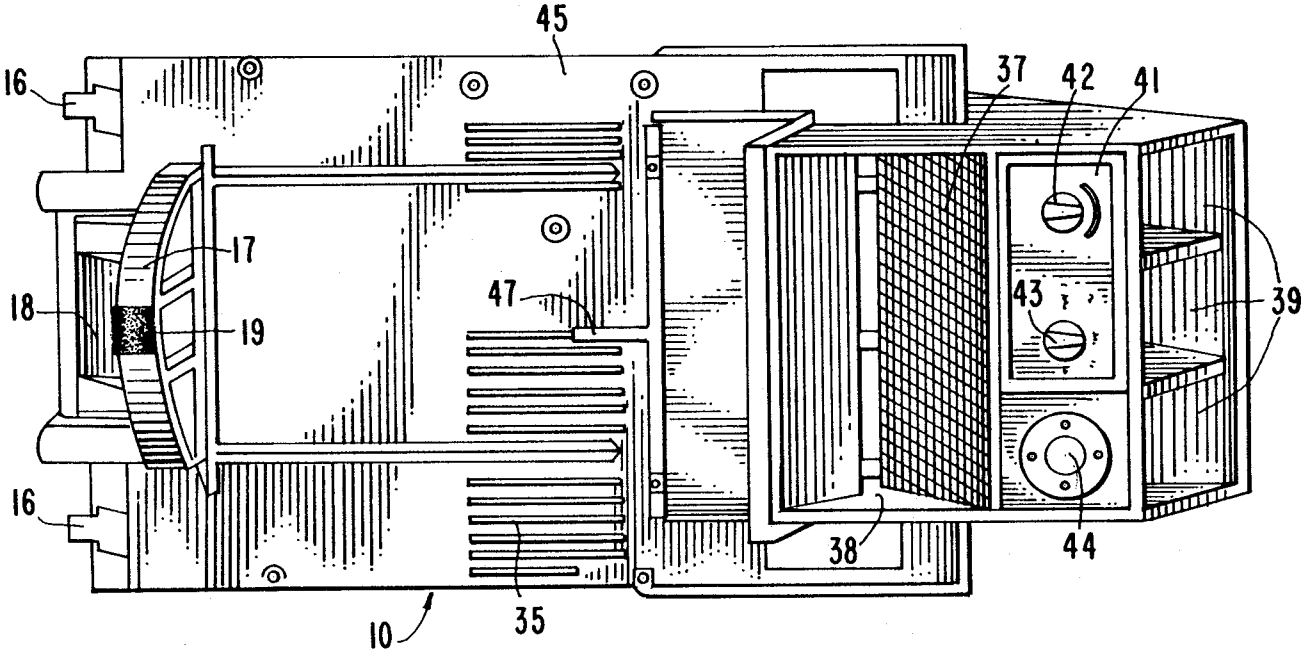
FIG. 6 is a perspective view looking directly upward centrally of the unit shown in FIG. 3.

Certain other parts that are attached on to or within the shell are shown in exploded view in FIG. 5. In addition to leg 17, leg cam mechanism pieces 18, leg foot pad 19, hatch pad 24, bulkhead 32, and separator 40 already described, there are shown base or frame 45 to which the shell is attached and inlet-outlet housing 46 which forms the lower part of ducts 38 and 39 and carries panel 41. As shown in FIG. 6, a condensate drain 47 is provided to carry water formed by the dehumidifying action of cooling coil 30 on the cabin air passing over it out of the unit onto the deck.

We claim:

1. A portable air-conditioning unit for through-hatch marine use comprising a base member on which air-conditioning mechanisms including a compressor, a heat exchanger, a cooling coil, and fans are mounted in their usual functional relationships characterized by a duct housing extending below said base member for insertion through a hatch opening fitted with a hatch combing which supports the duct housing end of said unit into a cabin space, a slidable leg carried by said base member and supporting the other end of said unit, an outlet duct within said housing by which warm cabin air is moved up by a fan through said coil, an inlet duct within said housing through which cooled air is returned from said coil to said cabin space, a cover shell carried by said base member enclosing said mechanisms, and a bulkhead within said shell separating its interior into tow compartments, one of said compartments not communicating with the atmosphere outside said cabin space and containing said coil and the fan and ducts associated with it, and the other of said compartments containing said compressor, said heat exchanger, a fan, and ducting through which outside air is moved by the fan through said exchanger.

2. A unit according to claim 1 in which the base member is provided with a camming device for locking the extension of the leg.

3. A unit according to claim 1 provided with a generally tubular weatherbag of generally L-shape, on end of the tube of which is secured weave girding the after end of the unit and the other end of said tube is secured by means surrounding the combing.

4. A unit according to claim 1 on which is mounted a 360° level indicator whereby the level position of the unit can be verified.

* * * * *